US006446581B1

(12) United States Patent
Carbone et al.

(10) Patent No.: US 6,446,581 B1
(45) Date of Patent: Sep. 10, 2002

(54) FLAMMABLE VAPOR RESISTANT WATER HEATER WITH LOW $NO_X$ EMISSIONS

(75) Inventors: Philip Carbone, North Reading; Karen Benedek, Winchester; Judith Reich, North Andover; Dewi Bramono, Malden, all of MA (US)

(73) Assignee: SRP 687 Pty. Ltd. (AU)

( * ) Notice: Subject to any disclaimer, the term of this patent is extended or adjusted under 35 U.S.C. 154(b) by 0 days.

(21) Appl. No.: 10/001,860

(22) Filed: Nov. 16, 2001

(51) Int. Cl.[7] ..... F22B 5/00

(52) U.S. Cl. ..... 122/13.01; 122/17.1; 122/17.2; 122/504

(58) Field of Search ..... 122/13.01, 17.1, 122/17.2, 18.3, 18.31, 19.1, 504

(56) References Cited

U.S. PATENT DOCUMENTS

| | | | | |
|---|---|---|---|---|
| 796,924 A | | 8/1905 | McCartney | |
| 4,869,232 A | | 9/1989 | Narang | |
| 4,940,042 A | * | 7/1990 | Moore et al. | 122/18.2 |
| 5,020,512 A | | 6/1991 | Vago et al. | |
| 5,335,646 A | | 8/1994 | Katchka | |
| 5,427,525 A | | 6/1995 | Shukla et al. | |
| 5,448,969 A | | 9/1995 | Stuart et al. | |
| 5,646,413 A | | 7/1997 | Benedek et al. | |
| 5,649,822 A | | 7/1997 | Gertler et al. | |
| 5,797,355 A | | 8/1998 | Bourke et al. | |
| 5,937,796 A | | 8/1999 | Sebastiani | |

* cited by examiner

*Primary Examiner*—Jiping Lu
(74) *Attorney, Agent, or Firm*—Schnader Harrison Segal & Lewis LLP

(57) ABSTRACT

A water heater including a water container, a combustion chamber adjacent the container, the combustion chamber having a side wall and at least one flame arrestor to admit air and extraneous fumes into the combustion chamber and confine ignition and combustion of the extraneous fumes within the combustion chamber, and a burner having a multiplicity of burner ports associated with the combustion chamber and arranged to combust fuel to heat water in the container, and an air diverter including a baffle plate with an upper surface and an outer edge portion, the diverter positioned in the combustion chamber and having a lower portion of the upper surface positioned at about the same height as at least a portion of the burner ports, the baffle plate sized to form a gap between the outer edge portion and the side wall such that flames generated by combustion of the fuel tend to attach to at least a portion of the lower portion, and a flange attached to and angled upwardly from the outer edge portion and adapted to channel combustion air passing through at least a portion of the flame trap through the gap to ensure uniform combustion and meter the relative amounts of primary and secondary air, with the net effect of optimizing combustion and minimizing $NO_x$ and CO emissions.

20 Claims, 5 Drawing Sheets

FLAMMABLE VAPOR RESISTANT WATER HEATER WITH LOW $NO_X$ EMISSIONS

FIELD OF THE INVENTION

This invention relates to water heaters, particularly to improvements to gas fired water heaters adapted to render them safer for use and to reduce $NO_x$ emissions.

BACKGROUND

The most commonly used gas-fired water heater is the storage type, generally comprising an assembly of a water tank, a main burner to provide heat to the tank, a pilot burner to initiate the main burner on demand, an air inlet adjacent the burner near the base of the jacket, an exhaust flue and a jacket to cover these components. Another type of gas-fired water heater is the instantaneous type which has a water flow path through a heat exchanger heated, again, by a main burner initiated from a pilot burner flame.

For convenience, the following description is in terms of storage type water heaters but the invention is not limited to this type. Thus, reference to "water container," "water containment and flow means," "means for storing or containing water" and similar such terms includes water tanks, reservoirs, bladders, bags and the like in gas-fired water heaters of the storage type and water flow paths such as pipes, tubes, conduits, heat exchangers and the like in gas-fired water heaters of the instantaneous type.

A particular difficulty with many locations for water heaters is that the locations are also used for storage of other equipment such as lawn mowers, trimmers, snow blowers and the like. It is a common procedure for such machinery to be refueled in such locations.

There have been a number of reported instances of spilled gasoline and associated extraneous fumes being accidently ignited. There are many available ignition sources, such as refrigerators, running engines, electric motors, electric and gas dryers, electric light switches and the like. However, gas water heaters have sometimes been suspected because they often have a pilot flame.

Vapors from spilled or escaping flammable liquid or gaseous substances in a space in which an ignition source is present provides for ignition potential. "Extraneous fumes," "fumes" or "extraneous gases" are sometimes hereinafter used to encompass gases, vapors or fumes generated by a wide variety of liquid volatile or semi-volatile substances such as gasoline, kerosene, turpentine, alcohols, insect repellent, weed killer, solvents and the like as well as non-liquid substances such as propane, methane, butane and the like.

Many inter-related factors influence whether a particular fuel spillage leads to ignition. These factors include, among other things, the quantity, nature and physical properties of the particular type of spilled fuel. Also influential is whether air currents in the room, either natural or artificially created, are sufficient to accelerate the spread of fumes, both laterally and in height, from the spillage point to an ignition point yet not so strong as to ventilate such fumes harmlessly, that is, such that air to fuel ratio ranges capable of enabling ignition are or are not reached given all the surrounding circumstances.

One surrounding circumstance is the relative density of the fumes. When a spilled liquid fuel spreads on a floor, normal evaporation occurs and fumes from the liquid form a mixture with the surrounding air that may, at some time and at some locations, be within the range that will ignite.

For example, the range for common gasoline vapor is between about 2% and 8% gasoline with air, for butane between 1% and 10%. Such mixtures form and spread by a combination of processes including natural diffusion, forced convection due to air current drafts and by gravitationally affected upward displacement of molecules of one less dense gas or vapor by those of another more dense. Most common fuels stored in households are, as used, either gases with densities relatively close to that of air (e.g. propane and butane) or liquids which form fumes having a density close to that of air, (e.g. gasoline, which may contain butane and pentane among other components, is very typical of such a liquid fuel).

In reconstructions of accidental ignition situations, and when gas water heaters are sometimes suspected and which involved spilled fuels typically used around households, it is reported that the spillage is sometimes at floor level and, it is reasoned, that it spreads outwardly from the spill at first close to floor level. Without appreciable forced mixing, the air/fuel mixture would tend to be at its most flammable levels close to floor level for a longer period before it would slowly diffuse towards the ceiling of the room space. The principal reason for this observation is that the density of fumes typically involved is not greatly dissimilar to that of air. Combined with the tendency of ignitable concentrations of the fumes being at or near floor level is the fact that many gas appliances often have their source of ignition at or near that level.

Earlier efforts, such as those disclosed in U.S. Pat. No. 5,797,355, substantially raised the probability of successful confinement of ignition of spilled flammable substances from typical spillage situations to the inside of the combustion chamber. Other following structures, such as those disclosed in U.S. Pat. Nos. 5,950,573; 6,003,477; 6,082,310; 6,085,699; and 6,085,700, for example, have built on the break through success of '355.

Although the water heaters described in the above-identified patents have been well received and highly successful with respect to increasing the resistance to ambient flammable vapors, certain portions of the U.S., especially California, have stringent low $NO_x$ emissions regulations and requirements. We have discovered an ongoing challenge associated with meeting these limits with such structures. Accordingly, it has been a primary objective to produce a water heater that simultaneously addresses the issue of resistance to flammable vapors and can meet ever increasingly stringent low $NO_x$ emissions regulations and requirements by the various regulatory bodies.

One attempt to limit $NO_x$ emissions is U.S. Pat. No. 5,645,413 to Benedek et al., which discloses a water heater designed to operate with unlimited burner primary air, and a key feature is to recirculate secondary air to the primary combustion flame region. In '413, the flame guide and burner are an integral system such that the burner does not function separately from the flame guide.

SUMMARY OF THE INVENTION

This invention relates to a water heater including a water container and a combustion chamber adjacent the container. The combustion chamber has a side wall and at least one flame arrestor to admit air and extraneous fumes into the combustion chamber and confine ignition and combustion of the extraneous fumes within the combustion chamber. A burner having a multiplicity of burner ports is associated with the combustion chamber and arranged to combust fuel to heat water in the container.

An air diverter including a baffle plate with an upper surface, an inner portion and an outer edge portion is positioned in the combustion chamber. The baffle plate has a lower portion of its upper surface positioned at about the same height as at least a portion of the burner ports. The baffle plate is sized to form a gap between the outer edge portion and the side wall such that flames generated by combustion of the fuel tend to attach to at least the inner portion of the baffle plate. A flange is attached to and angled upwardly from the outer edge portion and adapted to channel combustion air passing through at least a portion of the flame arrestor through the gap.

DETAILED DESCRIPTION OF THE INVENTION

Figure 1:
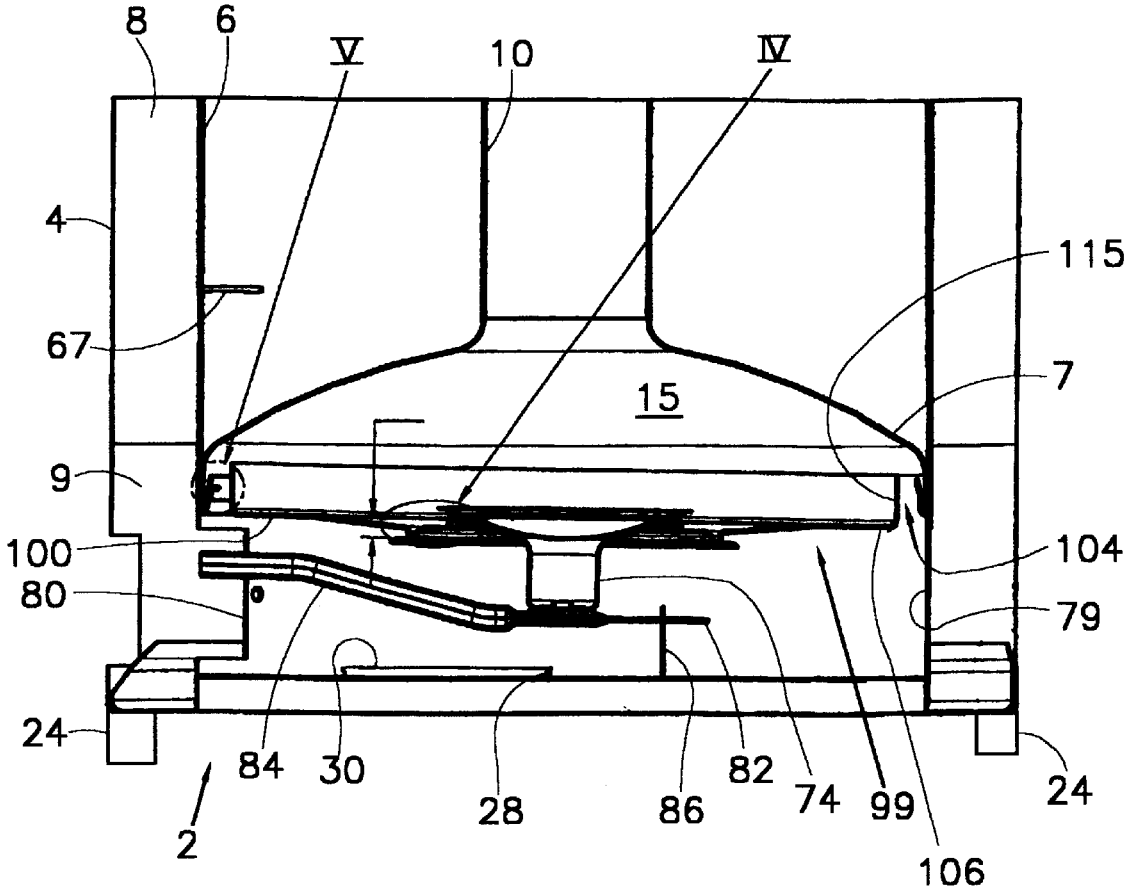
FIG. 1 is a schematic partial cross-sectional view of the lower half of a gas-fueled water heater having an air inlet and low $NO_x$ air distributor according to the invention.

It will be appreciated that the following description is intended to refer to the specific embodiments of the invention selected for illustration in the drawings and is not intended to limit or define the invention, other than in the appended claims.

Figure 2:
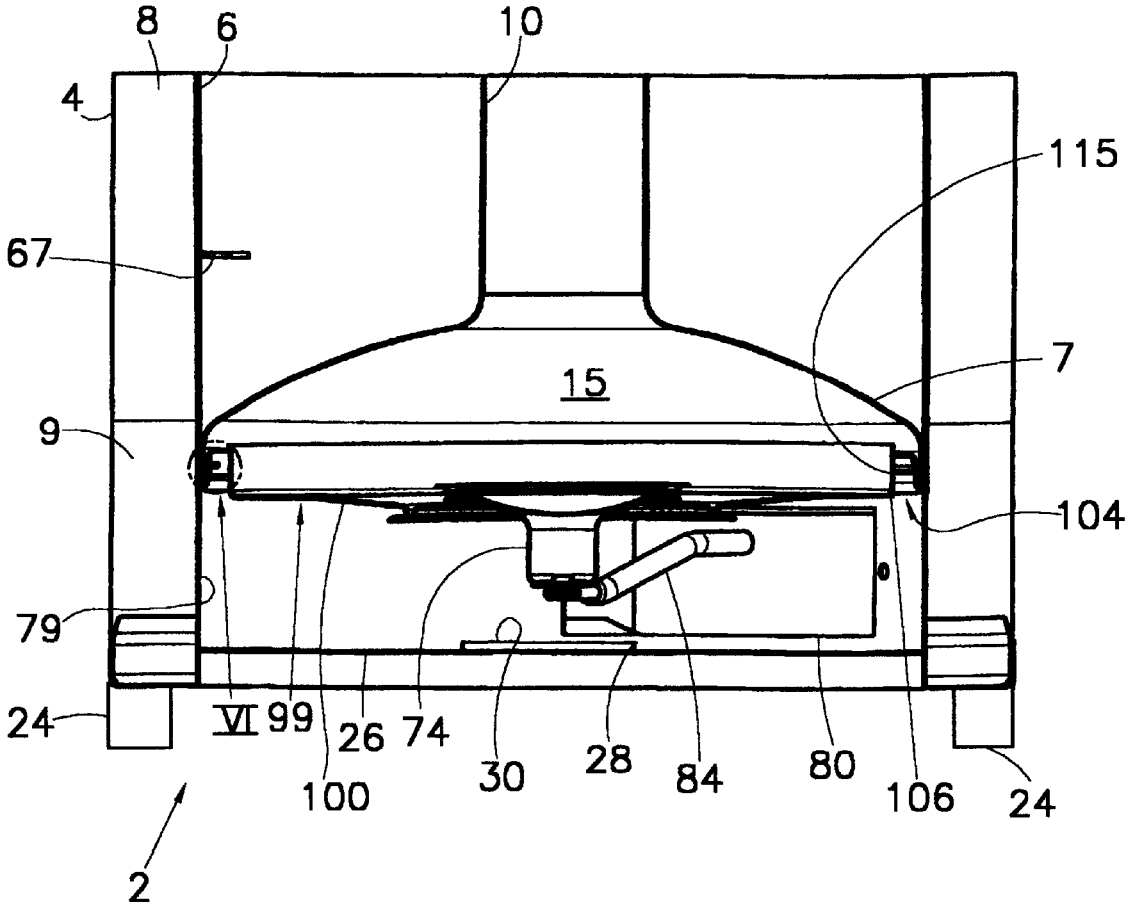
FIG. 2 is a schematic partial cross-sectional view of the water heater of FIG. 1 rotated by 60°.

Turning now to the drawings in general and FIGS. 1 and 2 in particular, there is illustrated a storage type gas water heater 2 including jacket 4 which surrounds a water tank 6 and a main burner 74 in a combustion chamber 15. Water tank 6 has a bottom 7 and is preferably capable of holding heated water at mains pressure and is further preferably insulated by foam insulation 8. Alternative insulation may include fiberglass or other types of fibrous insulation and the like. Fiberglass insulation 9 surrounds chamber 15 at the lowermost portion of water tank 6. It is possible that heat resistant foam insulation can be used if desired.

Located underneath water tank 6 is a pilot burner (not shown) and main burner 74 which preferably use natural gas as fuel or other gases such as LPG, for example. Other suitable fuels may be substituted. Main burner 74 receives combustion air through flame arrestor 30, which is installed in an aperture/opening 28 in base 26, and then combusts gas admixed with air and the hot products of combustion rise up through flue 10, possibly with heated air. Water tank 6 is lined with a glass coating (not shown) for corrosion resistance. The thickness of the coating on the exterior surface of water tank 6 is about one half of the thickness of the interior facing surface to prevent "fish scaling". Also, the lower portion of flue 10 is coated (not shown) to prevent scaling that could fall into combustion chamber 15 and possibly partially block off flame arrestor 30.

The fuel is supplied to both burner 74 through a gas valve (not shown) and fuel line 84. Flue 10 contains a series of baffles (not shown) to better transfer heat generated by main burner 74 to water within tank 6. Near the pilot burner is a flame detecting thermocouple (not shown) which is a safety measure to ensure that, in the absence of a flame at the pilot burner, the gas control valve shuts off the gas supply. The water temperature sensor 67, preferably located inside the tank 6, co-operates also with the gas control valve (not shown) to supply gas to the main burner 74 on demand.

The products of combustion pass upwardly and out the top of jacket 4 via a flue outlet after heat has been transferred from the products of combustion. The flue outlet discharges conventionally into a draught diverter which in turn connects to an exhaust duct leading outdoors.

Water heater 2 is mounted preferably on legs 24 to raise the base 26 of the combustion chamber 15 off the floor. As noted above, an aperture 28 is closed gas tightly by flame arrestor 30 which admits air for combustion of the fuel gas combusted through main burner 74 and the pilot burner, regardless of the relative proportions of primary and secondary combustion air used by each burner. Flame arrestor 30 is preferably made from a thin metallic perforated sheet of stainless steel, such as described in U.S. Pat. No. 6,085,699, for example.

Where base 26 meets the vertical combustion chamber wall or skirt 79, adjoining surfaces can be either one piece or alternatively sealed thoroughly to prevent ingress of air or flammable extraneous fumes. Gas, water, electrical, control or other connections, fittings or plumbing, wherever they pass through combustion chamber wall 79, such as at opening 80, are sealed with a closure plate (not shown). The combustion chamber 15 is air/gas tight except for means to supply combustion air through flame arrestor 30 and to exhaust combustion products through flue 10.

Pilot flame establishment can be achieved by a piezoelectric igniter (not shown). A pilot flame observation window (not shown) can be provided which is sealed. Cold water is introduced at a low level of the tank 6 and withdrawn from a high level in any manner as already well known.

Referring now to FIGS. 1–6, the invention also includes an air distribution, metering, and combustion staging apparatus 99 for combustion chamber 15 of water heater 2 equipped with flame arrestor 30. We found that flame arrestor 30 imposes a large flow restriction of the combustion air entering combustion chamber 15 as well as asymmetry in air distribution to burner 74. We also found that this flow imbalance produces nonuniform stoichiometry around the periphery of the typically axisymmetric burner 74, with resulting performance penalties in $NO_x$ production in the regions where stoichiometry is not optimal. These nonuniformities arise in both the primary combustion zone, where there may be incomplete mixing of the gas and primary combustion air, and the secondary region where combustion is completed by additional air available at the exit of the burner ports.

The reactions by which $NO_x$ is formed are strongly dependent on temperature, with higher flame temperatures producing substantially more $NO_x$ than the amounts created at lower temperatures. Since these high flame temperatures occur in mixtures closest to stoichiometric air/fuel ratios, it is desirable to avoid operating in such a regime. Generally, this is accomplished by ensuring that the overall combustion air is sufficient to increase the stoichiometric ratio well above a value of 1.0, typically to a value of 1.2 or above. Local stoichiometries, however, can vary significantly from the bulk value if air is provided in a nonuniform distribution to the burner and is incompletely mixed prior to combustion at the burner ports. Thus, some regions of the burner can be operating in a manner which produces high levels of $NO_x$ while other regions do not, resulting in an elevated average $NO_x$ concentration in the total flow of combustion products in the flue. Similar mechanisms can produce undesirable levels of CO emissions in nonuniform or poorly mixed gas/air mixtures if localized stoichiometries are such that the oxidation of CO to $CO_2$ cannot be completed before flame temperatures drop below a critical level.

Figure 3:
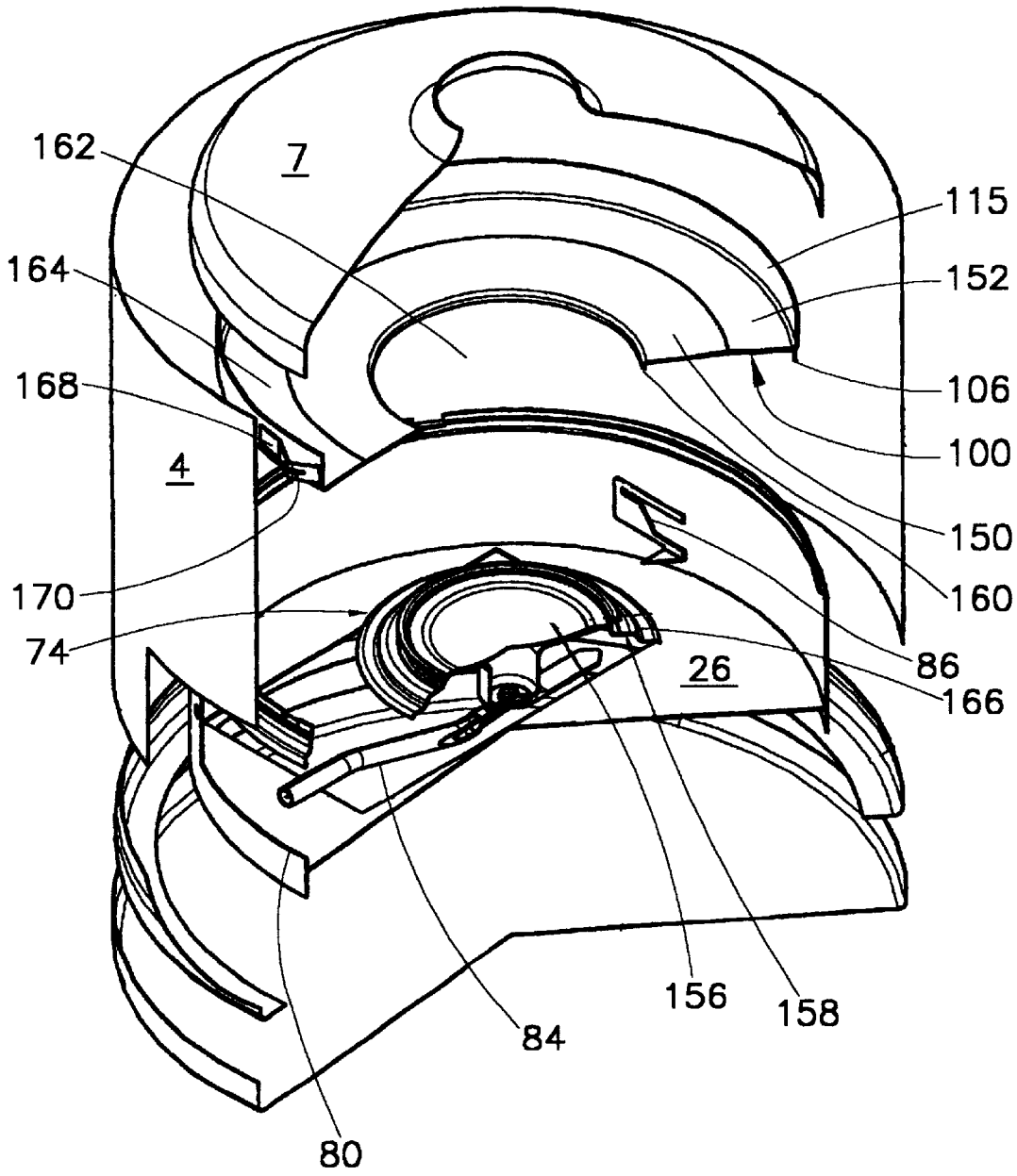
FIG. 3 is a schematic perspective view of the lower portion of the water heater of FIGS. 1 and 2 according to the invention, broken apart for ease of understanding.
Figure 4:
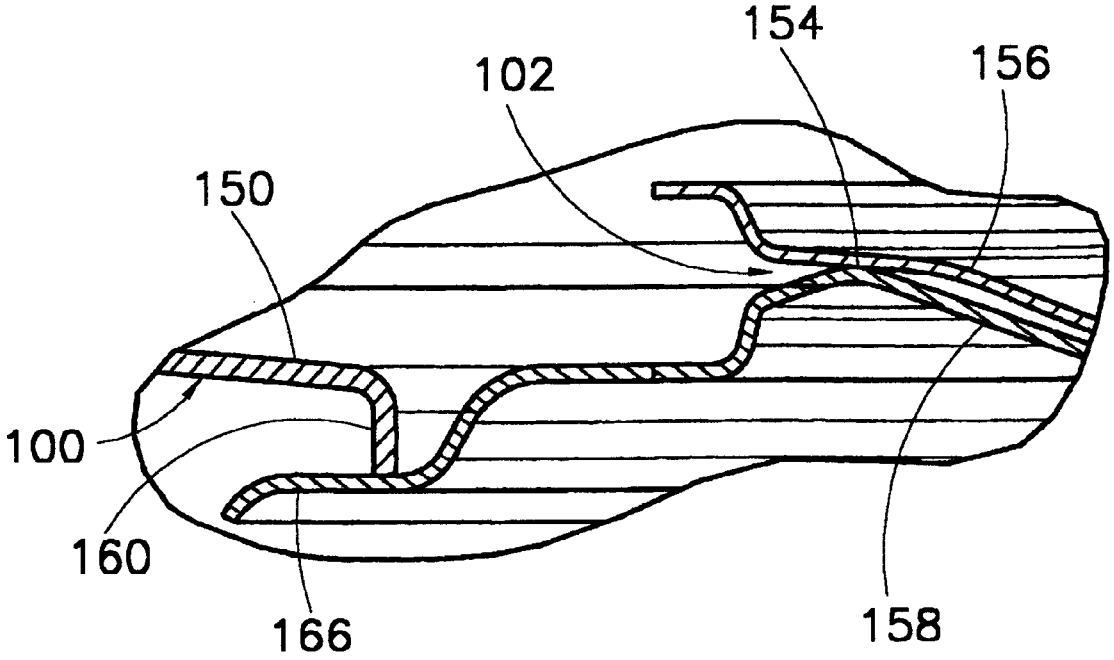
FIG. 4 is an exploded partial cross-sectional view taken from the phantom line IV of FIG. 1.
Figure 6:
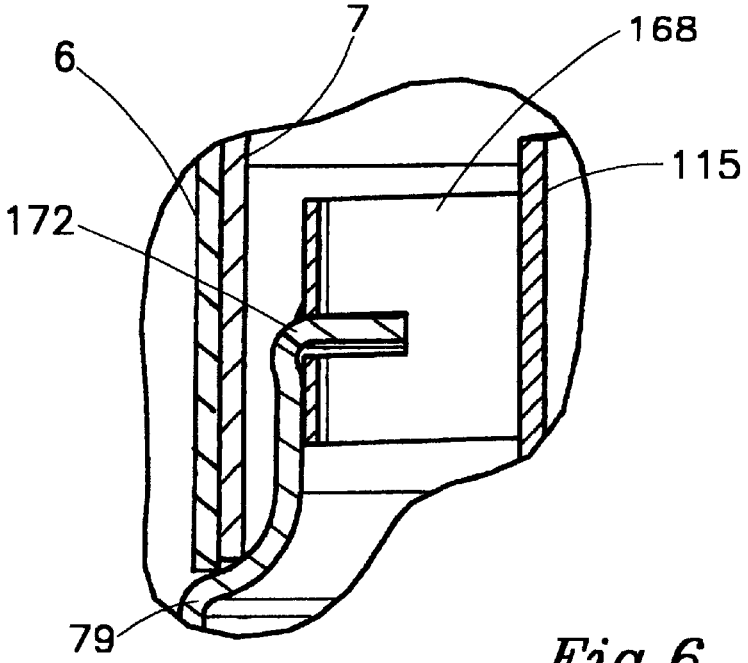
FIG. 6 is an exploded partial cross-sectional view taken from the phantom line VI of FIG. 2.
Figure 5:
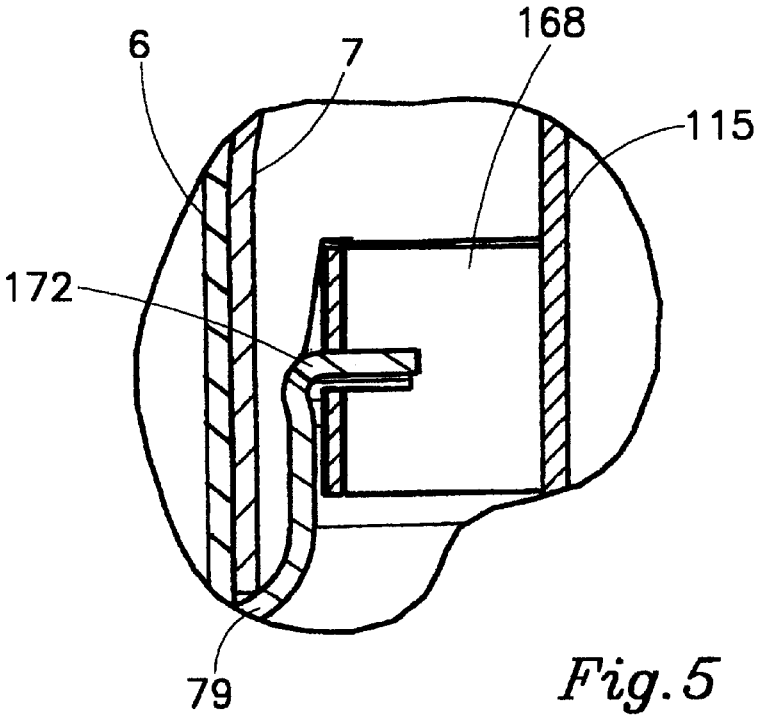
FIG. 5 is an exploded partial cross-sectional view taken from the phantom line V of FIG. 1.

Apparatus 99 of the invention improves the performance of the combustion system by providing a means to more evenly distribute the air entering chamber 15 via the flame arrestor 30 and thus produce a more uniform stoichiometry around the burner periphery. Referring particularly to FIGS. 3 and 6, a circular baffle plate 100 having an upper surface 152 is installed in chamber 15 substantially concentric with burner 74. An inner portion 150 of the surface 152 is located at about the same height as burner ports 102 formed between adjacent nodes 154 of upper metallic sheet 156 and lower metallic sheet 158 of burner 74. Plate 100 is positioned to allow burner 74 to be inserted and removed while plate 100 remains fixed in combustion chamber 15.

Inner portion 150 extends radially outwardly from inner edge 160, which forms a central opening 162, at an angle relative to horizontal in a range of about 5° to about 10° and terminates at a flat portion 164. The width of inner portion 150 is preferably about 1.5 times the width of flat outer portion 164. Inner edge 160 is most preferably substantially vertically oriented and rests upon or is supported by a lower lip 166 of burner 74.

The diameter of plate 100 is sized to create a gap 104 (see FIG. 2) between outer edge 106 of outer portion 164 and skirt 79 of combustion chamber 15 that is small relative to the overall diameter of combustion chamber 15. The gap 104 is preferably between about 0.25 and about 0.75 inches. The impingement and subsequent redistribution of air on the underside of plate 100 results in a more even flow to and around burner 74. Additionally, the pressure drop of the secondary air around outer edge 106 of plate 100 can be adjusted by the width of gap 104 between plate 100 and skirt 79 and/or gap between the top of flange 115 (see below) and bottom 7 of water storage tank 6, thus allowing more or less secondary air to be admitted.

Since the overall airflow into the chamber is restricted by flame arrestor 30, control of the secondary air accordingly provides a means to control the amount of primary air entering burner 74 and thus the overall primary fuel/air ratio. Additionally attached to upper surface 152 of plate 100 is flange 115 comprising a substantially vertically oriented ring located at outer edge 106. Flange 115 has a height, typically in the range of about 1–1.25 inch, that is relatively small compared to the diameter of baffle plate 100.

The upward slope/angle of inner portion 150 and the proximity of burner ports 102 causes the flames to attach substantially continuously to surface 152 of baffle plate 100, thereby transferring heat from the flames to the baffle plate 100 which reduces peak temperatures and minimizes $NO_x$ production. Baffle plate 100 and flange 115 control both radiative heat loss and the time the combustion gases spend in the primary combustion zone prior to secondary air being introduced. This in turn controls various combustion processes such as formation of $NO_x$ and the burnout of carbon monoxide.

Apparatus 99 is at least partially supported by a plurality of positioning brackets 168. Brackets 168 extend substantially horizontally outwardly from flange 115 at gap 104 and have an opening 170 sized and shaped to receive a bracket engager tab 172 that extends substantially horizontally inwardly from skirt 79 into gap 104. Each engager tab passes through opening 170 and enables baffle plate 100 to be substantially horizontally and vertically fixed into a desired position. This is especially important to maintain gap 104 substantially even between skirt 79 and outer edge 106/flange 115.

Also, the lowermost portion of inner edge 160 concentrically contacts burner 74 at lower lip 166 of lower metallic sheet 158 of burner 74. Such contacts provide for additional support and stabilization of apparatus 99 with respect to burner 74 and the remainder of the components associated with combustion chamber 15. As noted above, burner 74 is formed from upper metallic sheet 156 and lower metallic sheet 158, which are connected together at nodes 154, preferably by spot-welding or the like. Upper sheet 156 has a diameter that is less than lower sheet 158. Also, the diameter of upper sheet 156 is less than the diameter of opening 162, which permits the entire burner assembly, including burner 74, to be removed from combustion chamber 15 by way of opening 80 without disturbing and/or removing apparatus 99.

Bracket 168 preferably engages extender tabs 172 in a manner that provides substantially no lateral or vertical movement of baffle plate 100. Most preferably, extender tabs 172 are integral with an upper portion of skirt 79, although this is not required.

Thus, the invention serves to control the combustion processes by distributing total combustion air more uniformly, preferably substantially uniformly, and metering the relative proportions of the primary and secondary air, as well as by controlling the heat release and staging. Optimization of the overall burner system can include, but is not limited to, improvements in the emissions of $NO_x$ and carbon monoxide, the efficiency of heat transfer to the water storage tank, and the peak metal temperatures of the combustion apparatus.

Installation of apparatus 99 into combustion chamber 15 is preferably accomplished as follows:

Baffle plate 100 with flange 115 is installed permanently in combustion chamber 15 prior to attaching tank 6 to skirt 79. This is accomplished by engaging extender tabs 172 with their respective brackets 168. Later, burner 74 and the manifold assembly are installed into combustion chamber 15 through opening 80 such that burner 74 is raised up through the center of plate 100 and a seal is substantially formed between edge 160 of plate 100 and the extended lower lip 166 of burner 74. Burner 74 is then supported by the tip 82 of fuel line 84 at support bracket 86 and by the combustion chamber door. Of course, opening 80 is also sized and shaped for removal of burner 74 from combustion chamber 15.

It is to be understood that the invention disclosed and defined herein extends to all alternative combinations of the individual features mentioned or evident from the text or drawings. All of these different combinations constitute various alternative aspects of the invention. The foregoing describes embodiments of the present invention and modifications, obvious to those skilled in the art can be made to them, without departing from the scope of the present invention.

What is claimed is:

1. A water heater comprising:

a water container;

a combustion chamber adjacent the container, said combustion chamber having a side wall and at least one flame arrestor to admit air and extraneous fumes into said combustion chamber and confine ignition and combustion of said extraneous fumes within said combustion chamber;

a burner having a multiplicity of burner ports associated with said combustion chamber and arranged to combust fuel to heat water in said container;

an air diverter comprising a baffle plate with an upper surface formed from an inner portion and an outer portion, said diverter positioned in said combustion chamber and having the upper surface of the inner portion positioned at about the same height as at least a portion of said burner ports, said baffle plate sized to form a gap between an edge of the outer portion and said side wall such that flames generated by combustion of said fuel tend to attach to at least the inner portion of the baffle plate; and a flange attached to and angled upwardly from the outer portion and adapted to channel combustion air passing through at least a portion of said flame arrestor through said gap.

2. The water heater defined in claim 1, wherein the inner portion of the baffle plate is angled upwardly from a central axis extending through the baffle plate.

3. The water heater defined in claim 2, wherein about half of the baffle plate is angled upwardly.

4. The water heater defined in claim 1, wherein the outer portion of the baffle plate is substantially horizontal.

5. The water heater defined in claim 1, wherein the baffle plate inner portion has a central opening with an edge, the edge contacting a lower portion of the burner.

6. The water heater defined in claim 5, wherein the edge of the inner portion is substantially vertically oriented.

7. The water heater defined in claim 1, wherein the inner portion of the baffle plate is oriented at an angle of about 5° to about 10°.

8. The water heater defined in claim 1, wherein said gap is from about 0.25 to about 0.75 inches.

9. The water heater defined in claim 1, wherein said burner comprises two metallic sheets fixed together and wherein an upper sheet thereof has a smaller diameter than a lower sheet thereof.

10. The water heater defined in claim 9, wherein said metallic sheets are shaped to form a multiplicity of elongated and radially extending channels through which premixed gas and air flow prior to combustion.

11. The water heater defined in claim 9, wherein the lower sheet has a lower step portion upon which an edge of the baffle plate inner portion is supported.

12. The water heater defined in claim 1, wherein the flange is substantially vertical.

13. The water heater defined in claim 1, wherein the burner is removable from the combustion chamber without moving the diverter.

14. The water heater defined in claim 1, further comprising at least one positioning bracket extending outwardly from the flange and engaging the side wall.

15. The water heater defined in claim 14, wherein positioning bracket maintains the baffle plate in a selected position.

16. The water heater defined in claim 14, wherein the positioning bracket has an opening sized and shaped to receive a bracket engager tab extending inwardly from the side wall.

17. The water heater defined in claim 1, wherein the side wall has an opening sized to permit removal of the burner from the combustion chamber.

18. The water heater defined in claim 1, wherein attachment of the flames to the baffle plate upper surface lowers flame temperature and thereby reduces $NO_x$ emissions.

19. The water heater defined in claim 1, wherein the baffle plate and the gap are positioned to cause combustion air passing to the burner to be substantially uniform in flow rate around the burner outer edge portion.

20. The water heater defined in claim 1, wherein the baffle plate and the gap are positioned to meter the relative amounts of primary and secondary air.

* * * * *